US009976298B2

(12) United States Patent
Bergman

(10) Patent No.: US 9,976,298 B2
(45) Date of Patent: May 22, 2018

(54) CONCEALED STRUCTURAL POST FASTENING DEVICE AND METHOD

(71) Applicant: Richard Bergman, Ottawa (CA)

(72) Inventor: Richard Bergman, Ottawa (CA)

( * ) Notice: Subject to any disclaimer, the term of this patent is extended or adjusted under 35 U.S.C. 154(b) by 0 days. days.

(21) Appl. No.: 15/384,042

(22) Filed: Dec. 19, 2016

(65) Prior Publication Data

US 2017/0175384 A1 Jun. 22, 2017

Related U.S. Application Data

(60) Provisional application No. 62/269,846, filed on Dec. 18, 2015.

(51) Int. Cl.

| | |
|---|---|
| ***E04B 1/48*** | (2006.01) |
| ***E04H 17/22*** | (2006.01) |
| ***E04B 1/58*** | (2006.01) |
| ***E04F 11/18*** | (2006.01) |

(52) U.S. Cl.

CPC ..... *E04B 1/486* (2013.01); *E04B 1/5831* (2013.01); *E04F 11/1812* (2013.01); *E04H 17/22* (2013.01); *E04B 2001/5862* (2013.01); *Y10T 403/75* (2015.01)

(58) Field of Classification Search

CPC . E04H 17/22; E04H 12/2253; E04H 12/2261; E04H 12/2276; E04B 1/2604; E04B 2001/2684; E04B 1/4157; Y10T 403/75; Y10T 403/39; Y10T 403/3933; Y10T 403/3986; Y10T 403/46

USPC ..... 52/40, 155, 169.9, 301, 361, 364, 376, 52/745.17, 831, 832; 256/65.01, 65.17; 403/7, 274, 276, 277, 278, 279, 280, 281, 403/282, 283; 411/439, 487, 494, 479, 411/458; 248/346.01, 519, 511, 539

See application file for complete search history.

(56) References Cited

U.S. PATENT DOCUMENTS

| | | | | |
|---|---|---|---|---|
| 646,364 A * | 3/1900 | Donnelly | ..... | A47G 33/12 248/523 |
| 4,367,864 A * | 1/1983 | Eldeen | ..... | E04F 11/025 256/59 |
| 5,957,424 A * | 9/1999 | Krinner | ..... | E04H 12/2253 248/514 |
| 6,032,431 A * | 3/2000 | Sugiyama | ..... | E04B 1/2604 403/230 |

(Continued)

FOREIGN PATENT DOCUMENTS

| | | | | |
|---|---|---|---|---|
| CA | 2693251 A1 * | 8/2011 | ..... | E04H 17/1443 |
| FR | 2905134 B1 * | 1/2011 | ..... | E04H 12/2253 |
| GB | 585176 A * | 1/1947 | ..... | E04H 17/22 |

*Primary Examiner* — Robert Canfield
*Assistant Examiner* — Matthew J Gitlin

(57) ABSTRACT

A post fastening device for mounting a post to a construction surface, the device comprising a base having a planar top surface and a threaded rod extending from the top surface, a tubular member for insertion into a longitudinal axial bore on the bottom end of the post, the tubular member having an upper end and a lower end with internal threads complementary to the threads of the rod, and a dowel rod for insertion into a transverse bore extending through a portion of the post and the tubular member when the tubular member is in the longitudinal bore, the dowel rod being sized to pass through the tubular member and a portion of the post on both sides of the tubular member.

21 Claims, 14 Drawing Sheets

(56) References Cited

U.S. PATENT DOCUMENTS

| | | | | | |
|---|---|---|---|---|---|
| 6,141,928 | A * | 11/2000 | Platt | E04F 11/1812 | 256/65.14 |
| 6,367,224 | B1 * | 4/2002 | Leek | E04B 1/2604 | 403/187 |
| 7,398,961 | B2 * | 7/2008 | Froese | E04H 12/2253 | 256/65.14 |
| 8,117,798 | B2 * | 2/2012 | Bergman | E04H 12/2253 | 256/65.14 |
| 9,097,017 | B1 * | 8/2015 | Vanlennep | E04C 3/34 | |
| 9,238,909 | B2 * | 1/2016 | Imai | E04B 1/4157 | |
| 2005/0252124 | A1 * | 11/2005 | Bergman | E04H 12/2253 | 52/296 |
| 2009/0302290 | A1 * | 12/2009 | Appelman | A47F 10/00 | 256/64 |
| 2010/0025650 | A1 * | 2/2010 | Chung | E04H 17/1439 | 256/65.14 |
| 2012/0131879 | A1 * | 5/2012 | Bergman | E04F 11/1812 | 52/704 |
| 2014/0217347 | A1 * | 8/2014 | Green | E04F 11/1812 | 256/66 |
| 2015/0267437 | A1 * | 9/2015 | Kenton | E04G 21/3233 | 256/67 |

* cited by examiner

CONCEALED STRUCTURAL POST FASTENING DEVICE AND METHOD

BACKGROUND OF THE INVENTION

Field of Invention

The present invention relates to devices and methods of securing solid wood, fibrous or synthetic composite posts to mounting surfaces like wood, concrete, stone or other surfaces, in a manner that the entire connecting assembly is located inside the core of the post and its base is entirely underneath the end of the post.

Description of Related Art

Surface mounted solid wood posts and the like are commonly connected to their fastening or anchoring assemblies by way of screws driven through a flat plate and into the bottom of the post. These devices ultimately fail when the load imposed on the post exceeds the holding power of the screw threads in the post material or when the post splits and breaks apart. A common alternative style is a bracket-like device that the end of the post is fitted into. The device surrounds the post and cradles it. These devices tend to prevent a post from splitting apart but are highly visible and unattractive. The first location they tend to fail at is the base to surface mounting connection.

In U.S. Pat. No. 8,117,798 I described an advancement to the former style of fastening assembly by impaling a lightweight and rigid hollow tube with a sharp cutting edge into the center of the post; the other end of the tube being welded perpendicularly to a flat plate of steel with traditional screws going through the base into the post. This device and method was tested by an accredited third party engineering firm and proved capable of being used with wood posts in building code compliant residential guard rail applications for one and two family dwellings. It represented an improvement in performance and aesthetics and has been well received in the North American marketplace.

Despite this improvement, my earlier device is limited in residential building code applications to a maximum post spacing of six feet when used with thirty-six inch tall 4×4 posts. However, some applications call for forty-two inch posts. Some are for multi-residential or commercial environments where the performance standards are higher than for residential one or two family dwellings. And finally, some applications are for privacy fences up to six feet tall.

The performance of surface mounted post anchors decreases quickly as the height of the post increases. Therefore, most common solutions developed for the industry thus far have used hollow metal posts with square spacers or filler pieces that allow an extruded hollow plastic post to fit over the structural post like a sleeve to give the appearance of a solid post. These perform at high standards for railings but are very expensive.

In the field of construction and particularly for outdoor structures such as wood railings, pergolas, fences, balcony privacy panels, support posts and stand-alone posts for light fixtures and the like, there is a common problem of connecting solid posts made of wood, composite or other synthetic and fibrous material to hard surfaces where it is impossible to set the lower portion of the post into a sub-floor joist structure or a sub-terrain cement filled cavity. As post height increases and lateral load resistance decreases, surface mounted post assemblies become less and less effective even though they are generally more aesthetically pleasing. A compromise between higher performance and higher aesthetic quality has always been required.

Indeed, bridging these functional and aesthetic polarities has been a perennial objective in this field of art.

The field of prior art for surface mounted post brackets or anchors is replete with various examples of devices which can be arranged under the three general classes; tension style devices for hollow posts, internal compression style devices for hollow posts, screw style devices.

One of the earliest examples of the prior art is taught by Klein in U.S. Pat. No. 1,135,817. Klein teaches how to build a railing system using hollow posts with a full length threaded rod running from the top opening of the post to the bottom of the post. The rod fits through a large washer which rests on the top edges of the hollow post walls and transmits resistance as a nut is tightened down up on the rod and washer. The opposing end of the threaded rod is stationary and tightening the nut compresses the washer on the post walls which in turn creates a rigid moment resistant means of anchoring the post to the surface. The Klein device is intended for used with hollow posts.

Another similar example is taught by Nylund in U.S. Pat. No. 1,746,672 wherein he discloses a threaded tensioning rod fitted into a bored hole running the central axial length of a solid post, the terminus of said rod is set into an adhesive filled cavity within the concrete surface. The base of the post is also fitted into a shoe which cradles the lower portion of the post for added stability. Tightening a nut and washer fitted on the top end of the rod generates tension along the rod and compresses the post down upon the concrete surface such that it can resist moment forces.

This theme is repeated with variations by Saultz in U.S. Pat. No. 3,406,946. Saultz teaches the use of a threaded tensioning rod running the entire central axial length of an ornamental concrete post with the lower terminus of the rod embedded in an adhesive filled cavity. The upper end of the rod fits through an aperture in a cap rail and a nut and washer are fitted onto the rod. Tightening the nut generates tension along the rod and compresses the cap rail and post together such that it can resist moment forces generated at the top of the railing.

In more recent years the art has evolved to accommodate proprietary hollow exterior post extrusions which slide over the inner posts and anchors. McGuinness in U.S. Pat. No. 8,342,485 teaches the use of just such an apparatus designed to secure a hollow post and does so by incorporating a threaded steel rod and inner support member which accepts the rod in an aperture running along its central axial length; said support member in turn fitting tightly into the inner corners of a hollow post. A compression plate fits on the top of the support member with an aperture that the threaded rod fits through. The lower terminus of the rod is set into concrete or is fitted into a similar compression plate. When a nut is tightened from the top of the rod the tension generated compresses the support member and hollow post down upon the concrete or against the lower compression plate. In the latter example the post becomes a rigid unitary member and is fitted into a conventional cavity style post bracket. Screws are driven through the base walls of the post bracket and through the hollow walls of the post locking it into place.

Common among the four cited examples is the use of either a threaded solid steel rod or inner vertical structural member that runs the entire axial length of the post; that being at least 36". In the case of the Klein device use of a hollow post negates the need for drilling a long bore along the central vertical axis of the pole. The Nylund and Saultz devices are intended to be used with solid wood or concrete posts and therefore bores are required.

There are several immediate disadvantages found with these styles of devices. The first is the cost of the material. A solid threaded steel rod is long and heavy and therefore expensive and more difficult to efficiently package and ship. Secondly, it is difficult to accurately and easily drill a bore of at least 36" in length through solid wood. This difficulty is magnified by the need to ensure that the bore consistently and closely follows the central vertical axis of the post in order for all the parts to align properly and the resulting connection to function as intended. Boring a hole that requires the tolerances shown would mean using some kind of industrial drill press with a commensurate range of motion and accuracy. This is entirely impractical for the do-it-yourself or professional contractor marketplace that is both cost and time sensitive. Thirdly, the McGuinness device, and others like it, have no viability for use with solid wood posts and this disadvantage is one of the major short comings of the prior art because it leaves consumers without a high performing, aesthetically pleasing solution for use with wood posts that are intended to be shown and displayed for their visual beauty.

Internal compression devices have been used in various forms to secure hollow posts to surfaces. A common feature of this style of device is that they extend vertically to about one quarter to at most one third the total height of the finished post. They are comprised of fastening means which generate downward compression forces not unlike the first class of devices just described. Gehman in U.S. Pat. No. 5,359,827 and Platt in U.S. Pat. No. 6,141,928 disclose post mounts for hollow fence or rail posts using a central threaded solid steel rod to secure a short base structure over which the extruded hollow posts slide and are affixed. Forbis in US Patent Application Publication 2003/013608 teaches a variation of this concept by using vertically oriented solid threaded rods, rather than one, around which an internal support member is fitted and a hollow post slides over.

A derivative style of device employs solid threaded rods which engage wedges or cams that press and generate horizontal outward force between itself and the hollow post walls within which it resides. This idea is taught by Scott in U.S. Pat. No. 5,444,951 wherein he teaches the use of a device for providing stability for hollow vinyl fence posts. Halama in U.S. Pat. No. 7,188,457 also teaches the use of a modified version of a wedging device. These devices require the user to extend a socket with potentially multiple extenders down towards the lower zone within the hollow post in order to engage and tighten the nut. Still other versions of this concept have been used in the furniture industry to connect hollow legs to various mating parts like the device disclosed by Yalen in U.S. Pat. No. 2,972,495.

The third general class of post fastening devices and anchors within which my earlier U.S. Pat. No. 8,117,798 resides, comprises those devices employing threaded means or some derivation thereof to hold posts of solid material to a mounting surface.

A particularly elegant solution is taught by Kaaria in U.S. Pat. No. 4,753,420 wherein he explains the use of a threaded lag screw fitted into a base plate that fits under the post bottom and within the peripheral walls of the post to be attached to the assembly. The tip of the lag screw points upward perpendicularly from the horizontal floor surface. The post is prepared for attachment by pre-drilling a hole at the center of the bottom of the post and along the posts axial longitudinal axis. Pre-drilling the hole prevents the post from splitting and eases the installation. The post is then placed above the lag screw. The post and screw are turned and threaded together until the post bottom is flush with the base plate and can turn no further without stripping the wood fiber. The result is an attractive and secure post to floor connection with no external brackets or surrounding material cradling the post or protruding beyond the peripheral walls of the post.

Similar but different ideas have evolved along these lines, one of which is taught by Nicholas in U.S. Pat. No. 5,419,538. Nicholas teaches the use of two flat disc members embedded and screwed into the floor surface and the bottom of the post rendering each disc immobile. The disc members have a common threaded central aperture that accepts a threaded rod thus allowing the post to be screwed together with the disc residing in the cavity in the floor surface. The result is an aesthetically pleasing and fastener free appearance, as well as a simple installation.

Rock Lock Fastening Systems manufactures a post anchoring system (www.spring-bolt.com) that uses two springs which are screwed into a cavity in the floor surface and the bottom of the post. The springs mate together not unlike the familiar double helical coil of a DNA strand. Each screw has a flat surface at the end of the coil with an aperture through which a wood screw is driven to secure it within the bored cavity and the post or floor substrate. As the two coils intertwine they form a rigid cylindrical member that is resistant to bending, which in turn functions to keep the post vertical or close thereto while under lateral load. The result is an attractive fastener free post to floor connection and a relatively simple installation.

The common feature among the three cited devices is that each post is held together with the anchoring component by threaded means. The threaded means (screw) is fastened into the end grain of the post. End grain connected screws have less holding power than cross grain or transversely connected screws. The holding sufficiency of the screw into end grain is related to the diameter of the screw and the depth of the threaded teeth that cut into the wood fiber.

The Kaaria device functions only so long as the uplift forces generated by the lateral load remain lower than the holding power of the lag screw threads embedded into the end of the post. Since the device is intended to be used principally for softwoods common to outdoor construction, it is important during installation to ensure that the post is never over tightened or the threads may tear and churn the wood fiber resulting in no further increase in downward tension but rather a weakening of the thread to post connection. This risk is reduced the harder the wood is. But softwoods are the material of choice for the outdoor construction market. The Nicholas device has discs which are set and then screwed through and into the end grain of the post. The post also functions as intended only so long as those screws continue to retain their holding power in the post. The Rock Lock device functions similarly as well. The spring coil fitted into the post is held in place by a single screw embedded into the end grain of the post. The post fails when that screw pulls out of the wood post.

The device disclosed under my U.S. Pat. No. 8,117,798 also relies upon screws. However, the inclusion of a sharp hollow tube which is welded to the base of the anchor and impaled along the central longitudinal axis of the post imparts additional resistance to moment forces and absorbs some of the load that would otherwise be absorbed solely by the screws. This use of the tube is intended to attenuate some of the inherent performance challenges that the above mentioned threaded devices face and it does in fact increase the overall performance of the device. Extensive testing has determined the performance range and engineering limits of this device with reliable guidance for using it in residential railing applications. This body of testing data has shown where the limits of any post secured to a floor by end grain threaded means fails.

Since the weakest part of any of the threaded means devices is the holding power of the threaded means themselves, any solution must directly solve this problem. The inherent weakness of threading a fastener into end grain becomes more acute and better appreciated when one acknowledges that softwoods are the preferred source of material given its abundance and lower cost. Using harder woods to increase the performance standards of a fastener threaded into the end grain of a post is not an effective solution because they are more difficult to work with and multiple times more expensive than softwood species. An ideal solution must work well with the more common and less expensive softwood species.

The final class of devices among the prior art represent the most ubiquitous and simplest category of all and are used with soft and hardwoods. These are the exterior two or four sided devices that create a partially open or fully closed cavity within which the bottom of the post is fitted tightly into and secured by transverse screws or bolts. The post can be quite closely fitted and connected to a surface with sufficient strength so as to be adapted for its intended application, be that for a compression, tension or lateral load (moment) resistance function. To see how far this concept has evolved reference is made to two derivations of thereof.

The first is a heavy duty surface mount post anchor by Fiberon, one of the industry's leading composite decking manufacturer. The post anchor is designed to be used in conjunction with Fiberon's composite post sleeve. The post anchor appears similar to all four-sided cavity style brackets which are designed for the post to fit tightly into cavity and be screwed in place. The difference with this device compared to all other generic iterations is that its outside dimensions are 3.5"—the same dimensions of a common wood post. All materials for the flat base and the vertical side walls are made of heavier gauge steel to provide the most strength possible. It is also much taller than generic versions. It measures at least eight inches tall. The lower eight inches of the walls of the post must be cut away so that the lower portion of the post can fit inside the post bracket cavity. The outer walls of the post bracket are then flush with the walls of the upper portion of the post and the post sleeve can fit tightly over both the wood post and the post bracket. The device is not intended to be seen as it is not attractive. It is intended to be used for the proprietary post sleeve made by the manufacturer. There are no unique or innovative attributes to this device and its limitations are apparent.

The second example is a recent derivation thereof by Ozco Building Products which manufactures an attractive (www.ozcopro.com/56607-4×4-pb-ls-.html) post base kit employing the common four-sided external wrap around bracket. The product is designed for both higher performance compression, tension and lateral load resistance permitting it to also enter into the railing post category. This too is achieved by using heavier gauge materials which are intentionally styled to be visually pleasing, thus making the heavier material part of the aesthetic value of the finished device. This device represents the leading edge of this sub-class of the art.

A summary of the state of the art has shown that the tension style devices that utilize long solid threaded rods running the entire axial length of the post use a large amount of material, are heavy, awkward and function only with hollow posts or solid posts that must be machined with a precise central axial vertical bore that runs from end to end of a post. The amount of material alone sets the cost of this kind of solution very high. The skill and tools required to drill and accurately locate a central bore along a post thirty-six inches or longer immediately render it inaccessible for much of the mass market.

The internal compression devices which bear some similar features of the tension devices also only work with extruded hollow posts and cannot be modified for use with solid wood posts. The screw style devices lend themselves to uses with solid wood posts but are ultimately limited in their performance by the inherently weaker end grain screw connection.

The simplest external cavity or wrap around style devices have been so completely developed that the only remaining avenue of improvement is to increase material dimensions and design it to be more visually pleasing.

Although there have been devices and methods taught for nearly a century in the field of post anchor fastening assemblies, none of the prior art teaches or contemplates an improved way of securing a wood post to a surface that can resist compression, tension and lateral moment loads as well as the present preferred, but more expensive heavy metal posts. In fact, all of the strongest devices thus far developed are limited to uses where they must be covered by a synthetic extruded hollow post. There is no suitable solution that can be used with a beautiful softwood post such as pine, cedar or redwood and sustain a concentrated load of 500 lbs at 42" tall as a single free standing post.

An ideal solution should consider the many physical characteristics and properties of the materials available at this time and embody something that maintains the best aesthetic qualities of the forerunning solutions yet functions superiorly. New and unique advances in the art are not likely to follow the path of the latter external cavity style solutions just referred to. Instead, they are more likely to employ unique techniques and devices which further improve performance while also reducing aesthetic clutter and visibility. This evolutionary path provides the greatest range of benefits (reduced costs and greater latitude of application) to consumers but is certainly more difficult to traverse.

The ideal solution, being smaller, less visible, and yet stronger than the present examples of the art would be useful for beautiful solid wood posts and could also replace the expensive heavy steel posts currently used with extruded plastic hollow posts. It would use a superior means of resisting tension forces generated within a post while under load and perform better than existing threaded means devices that fail when the screws are pulled out of the end grain of a post.

Accordingly, there is a need for devices for anchoring soft and hard species of wood posts to surfaces for use as support posts, pergolas, gazebos, fences and guard rail posts on decks and balconies that are capable of performing within the same range as the present metal post predecessors in similar applications.

SUMMARY OF THE INVENTION

The present invention relates to devices and methods of securing solid wood, fibrous or synthetic composite posts to mounting surfaces like wood, concrete, stone or other surfaces (also referred to herein as a construction surface), in a manner that the entire connecting assembly is located inside the core of the post and its base is entirely underneath the end of the post. One of the objectives of the post fastening devices and methods of the present invention is to allow the use of commonly available yet affordable softwoods for post connections in railings, pergolas, gazebos, fences (which tend to be taller than railings), single free standing posts for light standards or for shade sail support posts and achieve higher lateral resistance performance than existing surface mount post anchors. Another objective is to eliminate the need to rely upon a more expensive hollow metal structural post which must be clad with a synthetic plastic or wood composite hollow exterior post to simulate the appearance of a wood post. Still, another objective is to make the post fastening assembly as small as possible so that it can fit completely under the bottom of the post and within the vertical plane of the peripheral walls of the post. A further objective is to create a post fastening assembly that can also be used as a compression base for support posts in structures such as timber frame buildings or pole barns and enjoy the benefits of exceptionally high tension (uplift) resistance and improved aesthetic quality. This would be desirable for many people employed in the field of timber frame, pole barn or other areas of construction where visibility is important.

Of course, those experienced in the art will know that there are inherent differences in the critical performance objectives of lateral load versus compression anchoring devices. Lateral load anchors must resist moment loads whereas a compression anchor must only resist a downward force. These differences mean that while the main components of the devices described herein are common, the dimensions of the materials and other minor features may vary in order to optimize the specific performance characteristic desired.

The current family of post fastening assemblies for compression and tension applications use the traditional "U" shape upper formation that a post can fit into with a lower appendage that can be set into wet cement or screwed down upon a wood or concrete surface. Any tension force imposed on the post is opposed by shear resistance of horizontal nails or screws driven in from the opposing vertical flanges of the device. These kinds of fasteners are known to have significantly lower tension resistance than a single continuous transverse fitted bolt through opposing flanges and the post. However even if a bolt is installed as such, the bolt and the vertical flanges of the "U" shaped formation remain highly visible.

The post fastening devices of the present invention achieve performance and aesthetic improvements, and enable the use of solid softwood posts, which are less expensive than the combined cost of a metal structural post and its composite or synthetic hollow post sleeve counterpart, while achieving virtually the same very high performance standards heretofore achieved only with heavy duty metal posts. Furthermore, the devices of the present invention eliminate the need for the more expensive hollow metal structural post, except in extreme performance applications, permitting use of an inexpensive softwood post of spruce or pine. The vinyl or composite sleeve could be fitted over the post after the installation if desired.

According to the present invention, an improved post fastening apparatus is provided that can be fitted entirely inside a solid wood post, occupying no more than one third the length of the post or less, depending on the species of wood used and the demands of the application to be met. The assembly is characterized by a hollow cylindrical tube which is set into a centrally bored cavity running vertically along the longitudinal axis of the post extending upwards in the post to at most one third the length of the post, and with threads machined in the inside wall of the lower end of the tube. The tube is set into the bore so that the base of the tube is flush with the bottom planar end of the post. The lower end of the tube is threaded onto a vertical threaded rod projecting from the middle of a flat planar base component which is in turn fastened to a surface on which the post is to be mounted using traditional screws or bolts depending on the type of surface. Once the post is turned tightly onto the threaded rod, the base of the tube sits flush with the top planar end of the bottom of the post. The tube is prevented from rotating or moving up or down within the bore in the post by a steel pin fitted into a transverse bore at the upper end of the tube within the post. The transverse bore starting on one planar face of the post wall and passing through the tube and into the other side of the wood post but terminating before exiting out the opposite side wall of the post. The pin is set slightly within the periphery of the wall and covered with a wood plug to conceal evidence of the hole. This is the general description of the device.

There are some variations with respect to dimensions and materials for a device intended for lateral load resistance or compression load resistance. These differences will now be described.

In the instance of a device intended for optimal lateral load or moment load resistance, a threaded rod or bolt, designed to mate with the threads inside the lower zone of the cylindrical tube, is defined in a horizontal planar steel base with perimeter dimensions that at most equal the cross sectional shape of the peripheral walls of the post. The threaded rod sits proud of the upper surface of the horizontal planar steel base at a perpendicular attitude. The stationary cylindrical hollow tube set within the wood post can be turned onto the threaded rod of the base until the bottom of the post is completely flush and in full contact with the base. The post can be further tightened to very high torque forces because the tube set within the post is fixed in position by at least one transverse pin and the tension forces generated along the axial length of the tube are more efficiently resisted by the countering shear resistance of the pin running horizontally through the tube and the wood post. Such configuration of vertical tube and transverse pin prevents the tube from being pulled downward along the inner bore more effectively than a tensional fastening configuration relying upon threaded means into the end grain of a post. The tighter the post can be screwed down upon the base the greater is the downward force that must be overcome by opposing uplift forces generated when a moment load is imposed up on the upper remote terminus of the wood post. Preferably the threads of the rod and the tube are both steel or other strong material, the two parts can be tightened to extremely high forces and the problem of vertical lag screws tearing and churning up the wood fiber of the post, as shown in the prior art examples, is avoided.

The described base with the threaded rod may itself be secured to a concrete or stone surface by way of conventional masonry style fasteners or expansion bolts. In the case of a wood framed structure commonly available RSS (rugged structural screws) screws may be used or for an even stronger installation a large flat steel plate may be fitted underneath blocking pieces inside a joist bay. Carriage bolts may be used to connect the base to the blocking and the plate below which dissipates load and prevents the nuts from being pulled up into the blocking pieces when the post is subject to lateral load.

The result is a post to floor connection with no visible fasteners and only the side profile view of the base visible after the installation. The benefits are that the assembly device is at most one third the length of the post using at least two thirds less material as contrasted with the Klien, Nylund and Saultz style devices and avoids the need of precisely boring along the axial center line of the post over greater distances. Furthermore, the mating of two steel threaded parts and the resisting of tension forces by transverse oriented pins vastly increases the horizontal load which can be imposed upon the top of the post. Another performance benefit is enjoyed by virtue of the strength of the tube to base and rod union which by itself is able to with stand very high moment loads. Wood posts can avoid being compressed on one side of the post bottom and lifted up on the other side leading to splitting, so long as the moment load imposed on the assembly is within the maximum range of resistance to bending of the tube in relation to the base. This range can easily be adjusted as needed for the desired application by increasing the thickness of the tube wall along the lower threaded zone, said wall thickness becoming thinner moving upward to the top of the tube where it is thinnest so that it may be easier to drill through the tube for inserting the transverse locking pin. The outer appearance of a wood post belies the inner functioning of a steel post which is in effect embedded deep within the wood post.

Now the differences of an embodiment of the post fastening assembly for use as a compression resistance anchor is described. A hollow tube may be used in the same manner as described for a lateral load resistant device except that the tubes overall length and diameter and wall thickness may be reduced to save material while still imparting sufficient compression or tension resistance performance. The tapering the tube wall thickness from thinner at the top to thicker at the bottom of the tube used for lateral resistance post fastening assemblies can be avoided in the tube for compression resistance devices.

The base, not being required to resist moment loads but only compression forces, can be made by bending and forming it to its required thickness or height and including corrugated folds underneath to meet the designated compression forces. Thinner sheet material would save considerable material and yet still perform the intended tasks to the required standards.

The post anchoring and fastening assemblies of the present invention achieve these and other objectives and represents a beneficial advancement in this field of art. The post anchoring and fastening device can be described in general terms as a hollow metal tube with threads tapped into the inner walls of the lower end of one end of the tube, a metal base which sits horizontally and secures to a surface with a centrally located and perpendicularly oriented threaded rod that mates with the inner threads at one end of the tube, the tube fitting into a centrally bored cylindrical cavity oriented along the longitudinal axis of the wood post and at least one solid metal pin of smaller diameter than the tube diameter, running transversely through a cylindrical aperture in the post and the upper end of the tube, resting in a blind position so as not to protrude out the opposite side of the post.

In order for the improved post fastening assembly to allow the softer wood species, such as western and eastern white cedar and redwood, to perform at an equivalent level as the slightly denser species, such as pine, hemlock and fir, a novel accessory bracket or support plate may be used. The accessory bracket comprises a planar sheet of metal, shaped similarly to the peripheral shape defined by the four walls of the post, but slightly smaller. A large central aperture in the bracket allows for the tube and the threaded rod of the post fastening assembly of the present invention to pass through unimpeded. Along each side of the accessory bracket is provided a blade appendage approximately 1" in width that extends upward from the planar sheet. Each blade appendage may include an inverted V cut along its top edge to define two prongs. The bracket is a lightweight accessory that is suited to being impaled into the end grain of a soft wood post. The prongs are small enough and set inward far enough to not split the softer wood material. Yet, the thin metal material provides sufficient tensile strength so that when a lateral moment force is applied at the upper remote end of the post, the softer wood material is prevented from splitting at the midpoint of the width of the bottom of the post and upward along a central and vertical grain line. The prongs remain firmly embedded into the wood with enough wood material on the outside face of the prongs and the outside peripheral wall surface of the post so that they do not cause the wood post to break in any way. The prongs are stressed the most at the 90° angle between prong and base surface and can resist immense tensional forces that are generated when the post is under lateral load such that the softer wood material remains intact, does not split, and the performance of the softest woods, like cedar and redwood, matches that of denser pine, hemlock and fir species. The accessory bracket may be referred to as a tension resistance bracket herein since that is the function it performs.

The tension resistance bracket or support plate need not be very thick, and may for example have a thickness of about 1/16" (1.5 mm), and when the post is firmly turned down upon the threaded rod in the base of the post fastening assembly, only a very faint reveal is visible.

The tension resistance bracket provides a functional enhancement to the post fastening assembly of the present invention but it also coincides with the need to maintain maximum aesthetic value. Therefore, the tension resistance bracket delivers specific function and form attributes in a most elegant manner. This is in contrast to the functional equivalent of an exterior collar or clamp tightened around the base of the post that would theoretically perform the same function but in a manner that would be unsightly.

In some aspects, the present invention provides a method of mounting a post having a bottom end to a construction surface, the method comprising: mounting onto the construction surface a base having a planar top surface and a threaded rod extending from the top surface; machining a longitudinal bore into the bottom end of the post along a central longitudinal axis of the post; inserting into the longitudinal bore a tubular member having an upper end and a lower end with internal threads complementary to the threads of the rod, the tubular member being sized to be received within the longitudinal bore with a friction fit therebetween; machining a transverse bore passing through a portion of the post and the tubular member; inserting a dowel rod into the transverse bore in a manner that the dowel rod passes through the tubular member; and threading the lower end of the tubular member onto the rod of the base and tightening thereof until the post is secured to the base and thereby to the construction surface. In some embodiments, the threaded rod on the base may be located at the center of the top portion. In some embodiments, threaded rod may be perpendicular to the top surface.

In some embodiments, the base may further include a planar bottom surface opposite the top surface and a plurality of mounting holes extending from the top surface to the bottom surface, and the step of mounting onto the construction surface may comprise securing the base to the construction surface with screws or bolts through the mounting holes. In some embodiments, the mounting holes may be countersunk with respect to the top surface so that heads of the screws or bolts are flush or below the top surface.

In some embodiments, the method may further comprise the step of mounting a support plate onto the bottom end of the post prior to the step of threading the lower end of the tubular member onto the rod, the support plate having a hole sized to accommodate the lower end of the tubular member, and the step of mounting the support plate includes aligning the hole with the longitudinal bore.

In some embodiments, the support plate member may include one or more blades extending from one side of the support plate and the step of mounting the support plate may comprise driving the blades into the bottom end of the post.

In some aspects the present invention provides a post fastening device for mounting a post to a construction surface, the device comprising: a base having a planar top surface and a threaded rod extending from the top surface; a tubular member for insertion into a longitudinal axial bore on the bottom end of the post, the tubular member having an upper end and a lower end with internal threads complementary to the threads of the rod; and a dowel rod for insertion into a transverse bore extending through a portion of the post and the tubular member when the tubular member is in the longitudinal bore, the dowel rod being sized to pass through the tubular member and a portion of the post on both sides of the tubular member. In some embodiments, the threaded rod on the base may be located at the center of the top portion. In some embodiments, the threaded rod may be perpendicular to the top surface.

In some embodiments, the base may further include a planar bottom surface opposite the top surface and a plurality of mounting holes extending from the top surface to the bottom surface for receiving screws or bolts for mounting the base to the construction surface. In some embodiments, the mounting holes may be countersunk with respect to the top surface so that heads of the screws or bolts are flush or below the top surface.

In some embodiments, the device may further comprise one or more threaded levelling holes passing through the base from the top surface to the bottom surface and being adjacent an edge of the base, and a set-screw within the one or more levelling holes being flush or below the upper surface and operable to act against the construction surface to raise or lower the base relative to the construction surface to effect tilting of the rod.

In some embodiments, a levelling plate may be provided for placement between the base and the construction surface to provide a rigid surface upon which the set-screw of the one or more leveling holes may operate.

In some embodiments, the device may further comprise a support plate having a hole sized to accommodate the lower end of the tubular member and adapted to being fastened onto the bottom end of the post with the hole aligned with the longitudinal bore. In some embodiments, the support plate may include one or more blades extending from one side of the support plate for being driven into the bottom end of the post. In some embodiments, the one or more blades may be positioned around the periphery of the hole and no less than about ⅝" away from the hole. In some embodiments, the one or more blades may include a V cut on the leading edge to define pointed prongs to facilitate the impalement of the blade into the bottom end of the post.

In some embodiments, the tubular member may define an upper portion and a lower portion, and the upper portion defines diametrically opposed planar longitudinal external surfaces. In some embodiments, an external surface portion of the tubular member adjacent the lower end includes a reference mark vertically aligned with one or more of the planar longitudinal external surfaces.

Those experienced in the art will also understand the minor modifications to the above described key features for optimized use as a compression anchor device.

BRIEF DESCRIPTION OF DRAWINGS

For a better understanding of the present invention and to show more clearly how it may be carried into effect, reference is made by way of example to the accompanying drawings in which.

DETAILED DESCRIPTION

Figure 1:
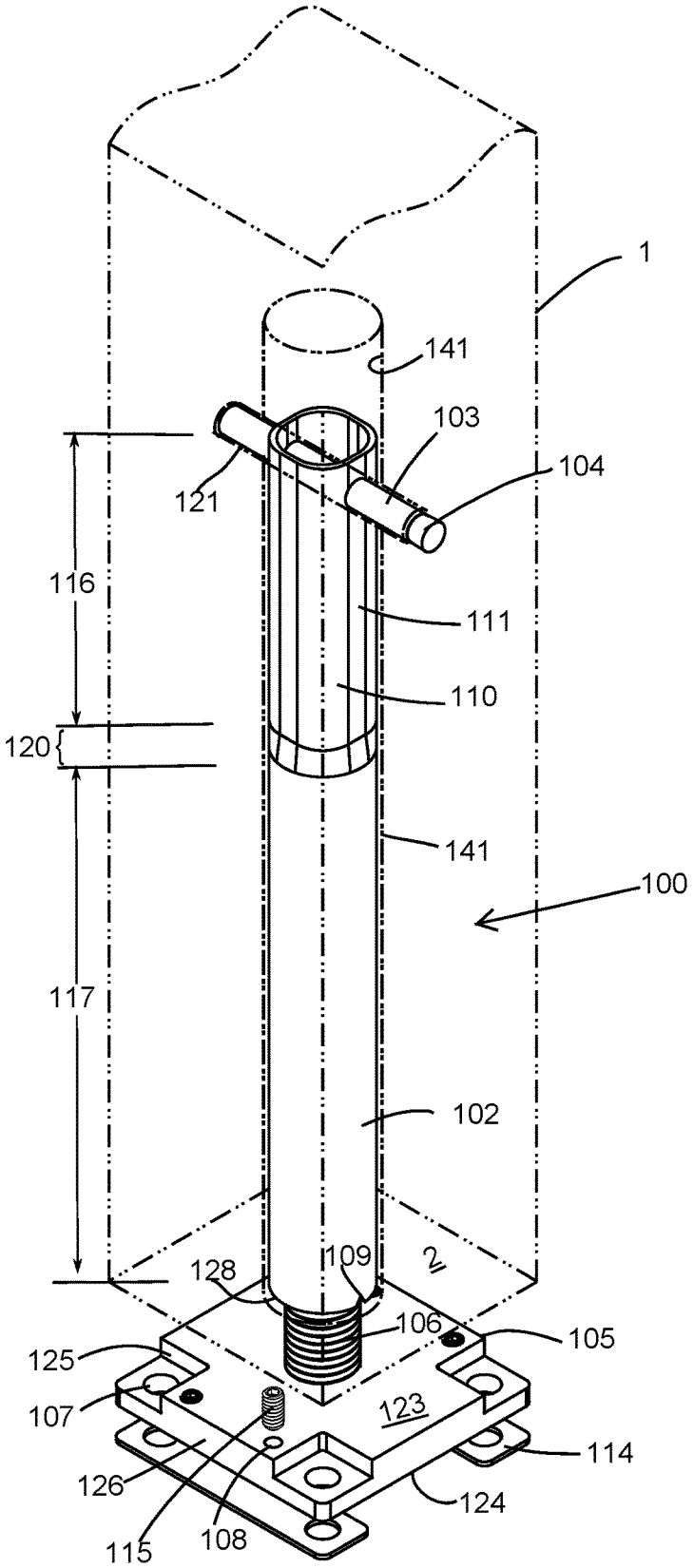
FIGS. 1 and 2 are perspective views of an embodiment on a post fastening device set within a solid wood post before and after the post and tube have been screwed onto the lower base where the base lies inside the periphery of the side walls of the post.
Figure 2:
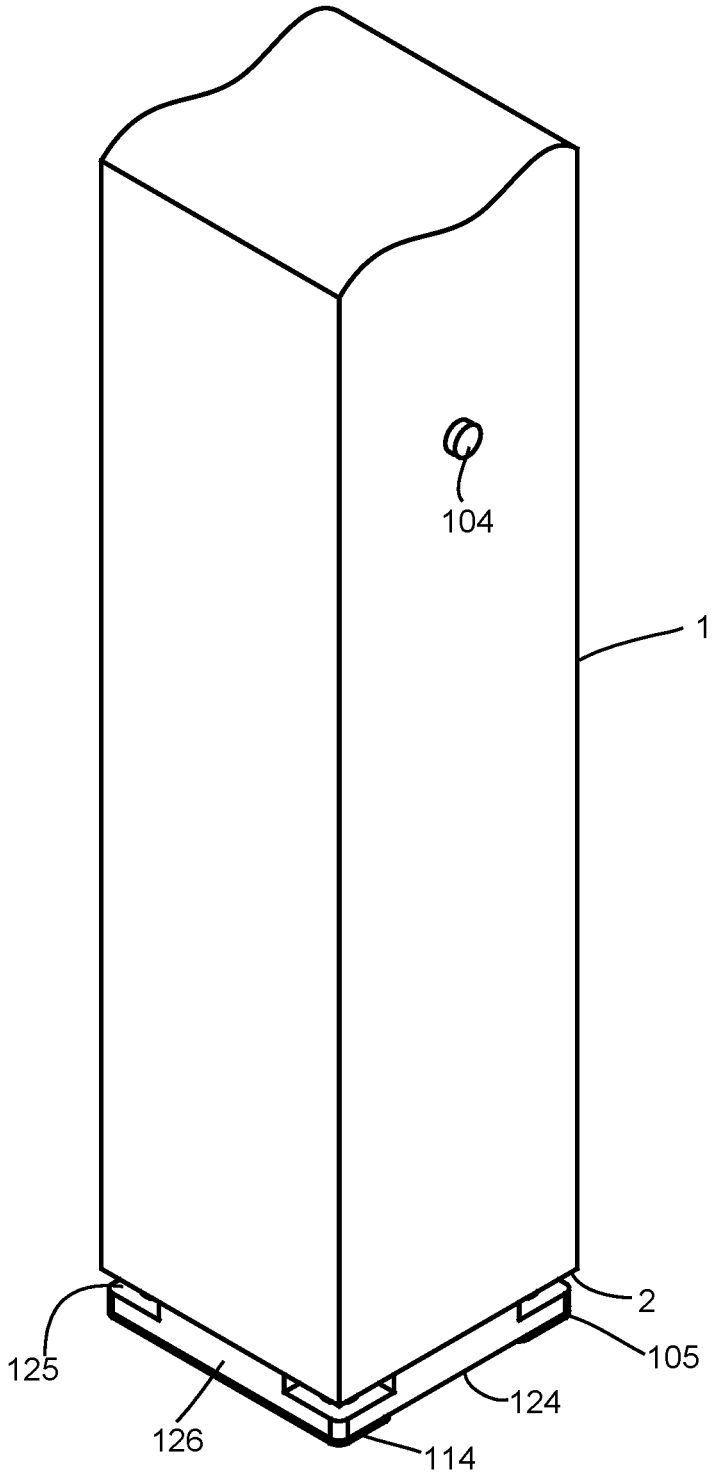
Figure 3:
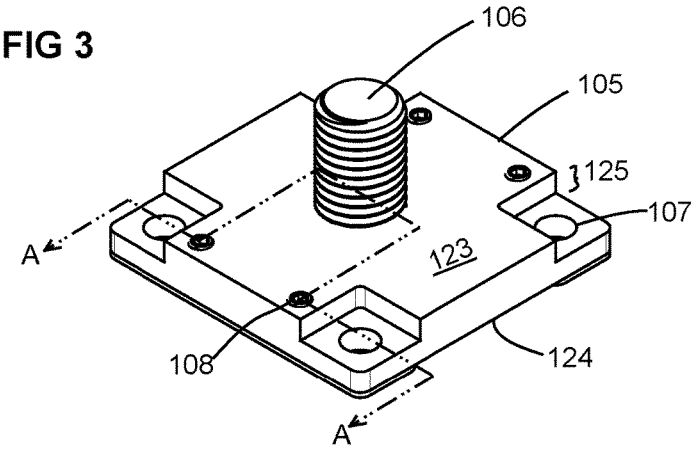
FIG. 3 is a perspective view of an embodiment of the base of the post fastening device of FIG. 1 with the threaded rod in place.
Figure 4:
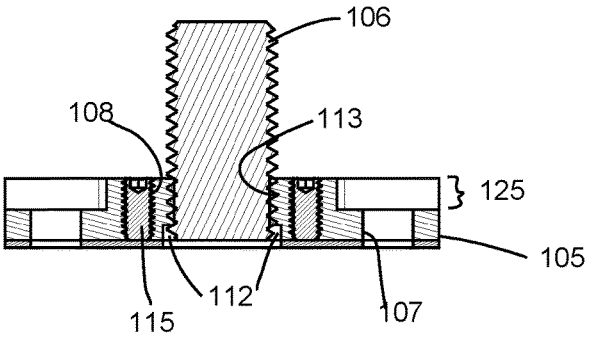
FIG. 4 is a cross sectional view along line A-A of the base of FIG. 3 showing the through holes for the threaded rod and fasteners as well as the welding cavities adjacent to the aperture for the rod.
Figure 5:
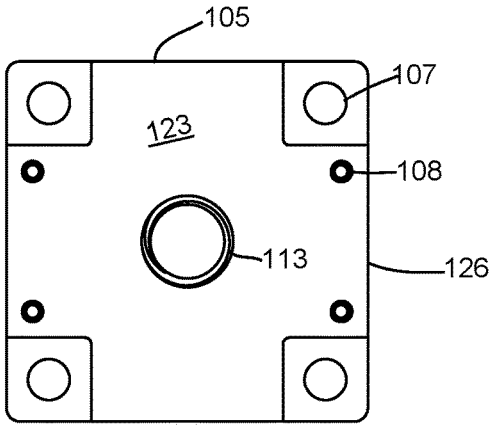
FIG. 5 is a top view of the base of the device in FIG. 3 depicting the fastener holes, set screw holes and aperture for the rod.
Figure 6:
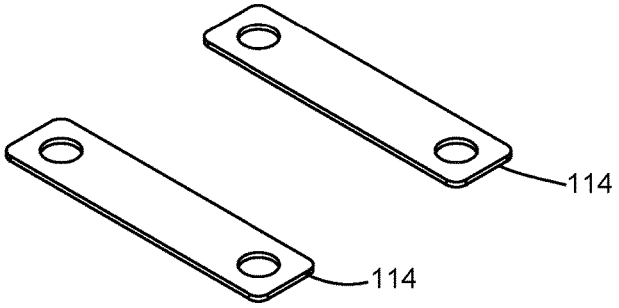
FIG. 6 is a perspective view of an embodiment of a surface leveling plate.

For the purposes of promoting an understanding of the principles of the invention reference will now be made to the exemplary embodiment illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Referring to FIGS. 1-10, there is depicted an embodiment of a post fastening device 100 in accordance with the present invention. The post fastening device 100 is comprised of three major components: a base member or base 105, a tubular member or tube 102, and at least one transverse locking pin 103. An optional surface leveling plate 114 may be provided. A solid wood post 1 is shown within which the device is installed.

The base 105 is defined by a planar top surface 123, a bottom or lower planar surface 124 and vertical side walls 126, which in the illustrated embodiment form a square. Alternatively, the base member may be in any shape to match the cross-sectional dimensions of the post with which it is being integrated. For example, the base may be circular to fit a round post such as a log. It may also be rectangular to match a nominal 4"×6" dimensional piece of lumber, and the like. In the illustrated embodiment, the base 105 is a unitary piece and may be made of either machined or cast metal or plastic.

The upper planar surface 123 is recessed in at least four locations where fastener holes 107 are bored to accept either screws or bolts 122. The depth of the recess is sufficient to create a space 125 that permits the head of a fastener to sit below the plane of the upper surface 123 so as not to interfere with the bottom surface 2 of the post 1. This in turn permits the bottom surface 2 of the wood post to rotate until it is compresses tightly onto the upper surface 123 of the base 105 as is further described below herein. Threaded levelling apertures 108 are shown passing through the upper 123 and lower 124 surfaces of the base, proximate to the perimeter of the side wall 126 and between adjacent fastener holes 107. A set screw 115 may be inserted into the aperture 108 and adjusted to bring the upper planar surface 123 into horizontal level as desired on any given surface. The lower surface of the set screw makes contact with a flat surface upon which the base 105 is mounted, or the leveling plate 114 if such is used, which is defined by the same peripheral shape as the base above it.

A threaded rod 106 extends from the upper surface 123 at the center of the base 105 and is oriented perpendicularly relative to the upper planar surface 123. One mode of making the threaded rod 106 is by providing a threaded aperture 113 in the center of the base 105 into which a threaded rod is screwed until the planar surface of its lower terminus is flush with the bottom planar surface 124 of the base. The rod 106 is then fixed in place and prevented from rotating by two precise welds which fill two cavities 112 formed within the lower planar surface 124 and the inner circumferential walls of the threaded aperture 113. There are other ways of providing the threaded rod 6 on the upper surface 123 of the base that are within the knowledge of the skilled reader.

The tube 102 has an upper end and a lower end, and is defined in an upper portion 116 by diametrically opposed planar longitudinal external surfaces such as flat longitudinal surfaces 111 running along the length of the upper portion 116, which flat longitudinal surfaces 111 are separated by the adjacent longitudinal circumferentially rounded surfaces 110 of the tube. A transitional zone 120 separates the upper portion 116 from a lower cylindrical portion 117 of the tube, which is preferably has a thicker wall than the upper portion 116.

The perspective view shown in FIG. 1 shows the tube 102, a longitudinal central bore or cylindrical cavity 141 within the post 1, a transverse dowel rod such as pin 103 that is installed into a transverse bored hole 121 within the wood post 1, and wood plug 104. The pin 103 passes through the tube 102 on the flat formed surface 111. Also shown is the bottom edge 128 of the tube 102, and one of two notches 109 defined at 180 degrees from each other along the circumferential bottom edge 128 of the tube 102. The lower inner walls of the tube are further defined by internal threads 138 (shown in FIG. 7) which mate with the threaded rod 106. The notches 109 are positioned along the circumference of the tube so that each notch 109 aligns with a flat surface 111 on the upper portion 116 of tube 102.

Figure 7:
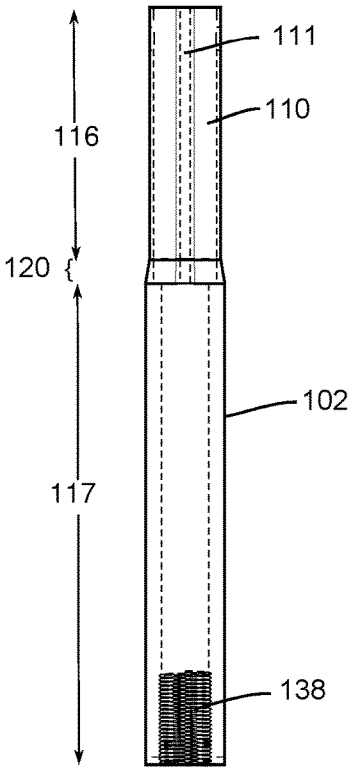
FIG. 7 is a cross sectional view of the tube of FIG. 1 depicting the interior threaded lower area, the tapered upper portion and the different wall thicknesses between the lower portion of the upper portion.
Figure 8:
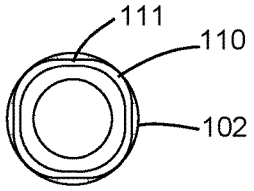
FIG. 8 is a top plan view of the tube shown in FIG. 7.
Figure 9:
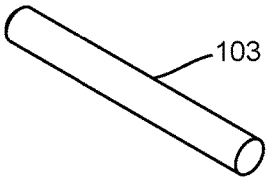
FIG. 9 is a perspective view of the transverse pin shown in FIG. 1.
Figure 10:
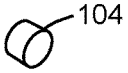
FIG. 10 is a perspective view of the wood plug shown in FIG. 1.
Figure 11:
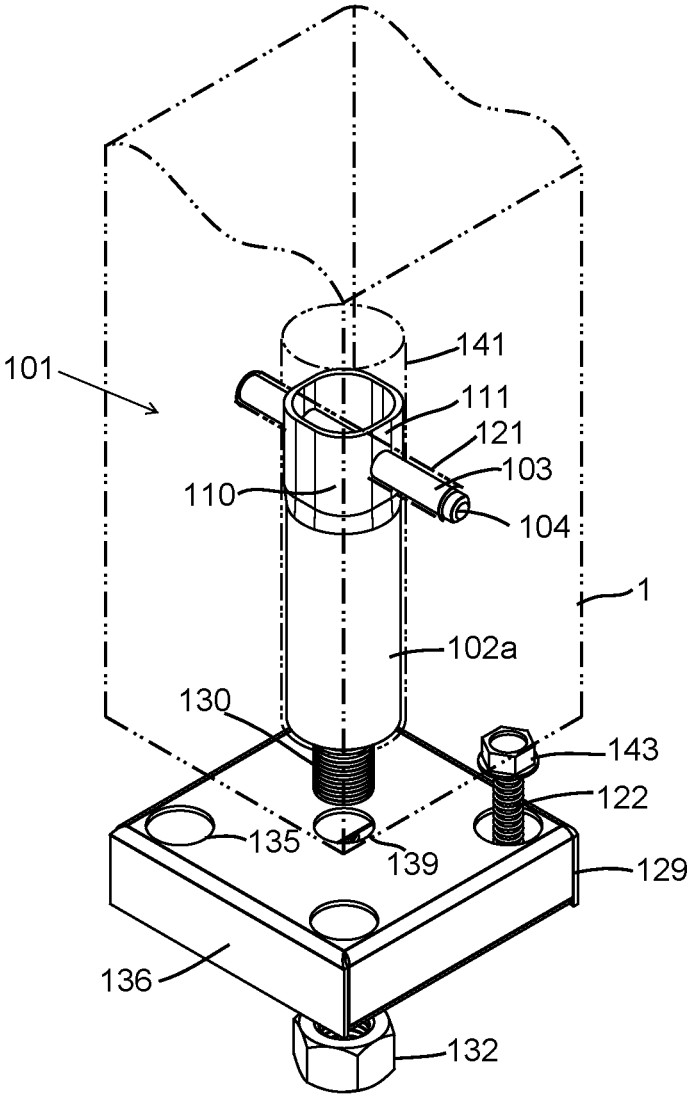
FIGS. 11 and 12 are perspective views of another embodiment of a post fastening device directed to compression loads, prior to being attached to its base and after installation.
Figure 12:
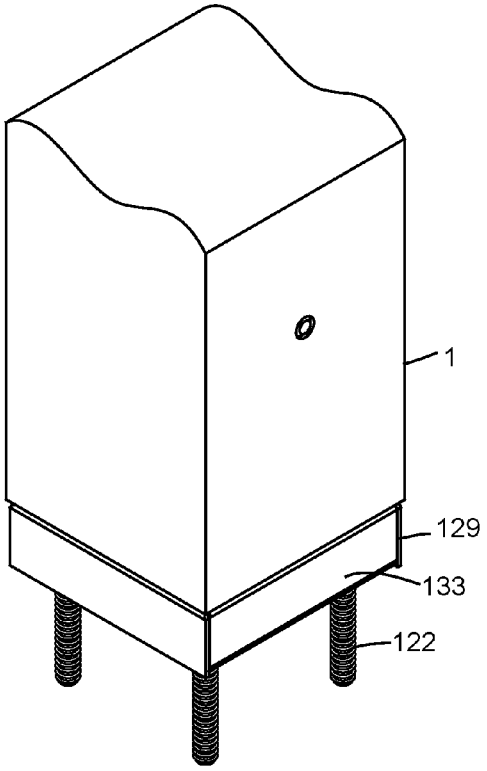
Figure 13:
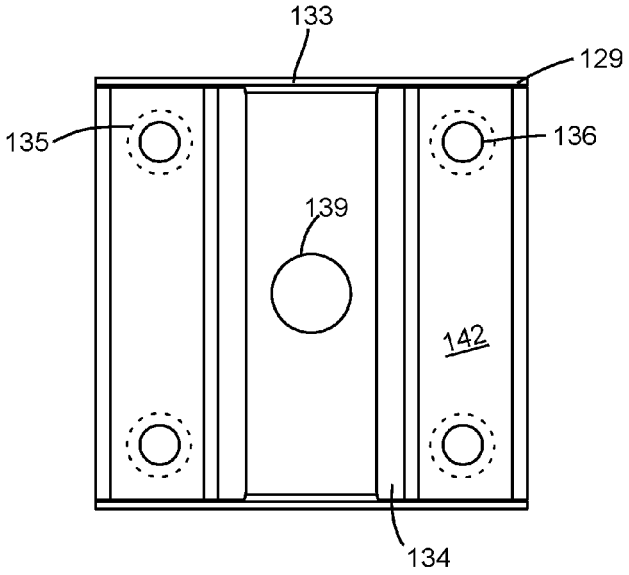
FIG. 13 is a bottom plan view of the base shown in FIGS. 11 and 12.
Figure 14:
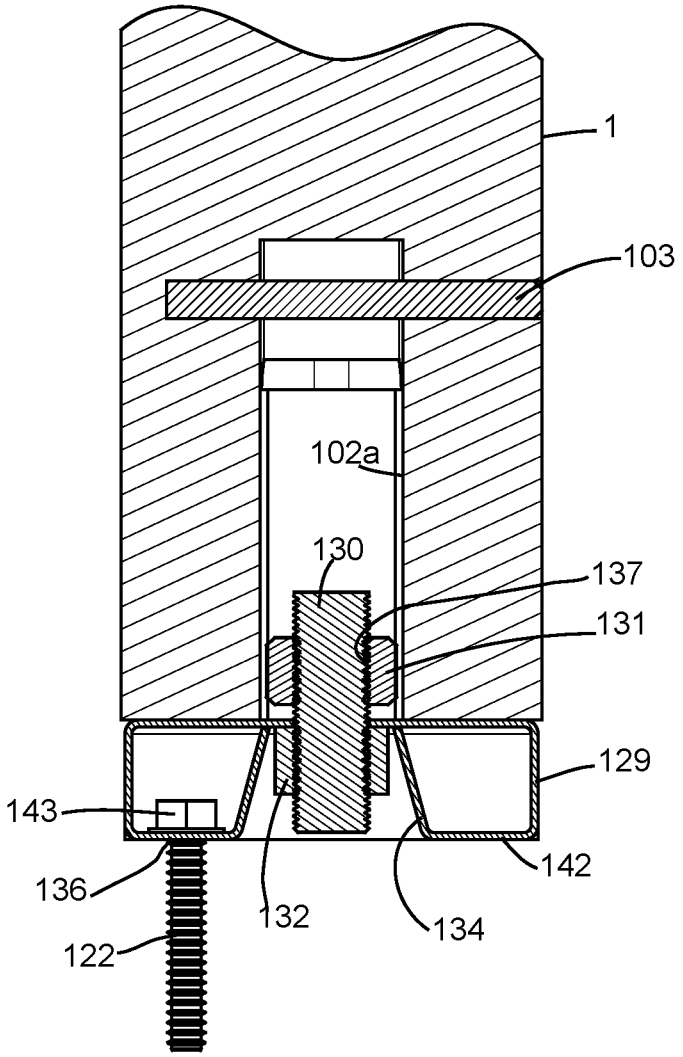
FIG. 14 is a side sectional view of the post fastening device shown in FIGS. 11 and 12.
Figure 15:
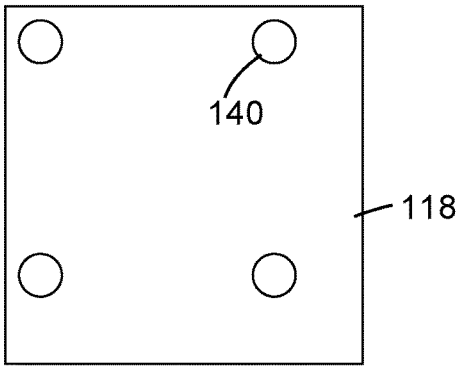
FIGS. 15 and 16 are a top and a side views of a wood structure installation plate.
Figure 16:
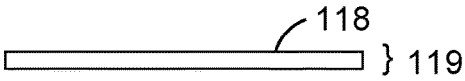
Figure 17:
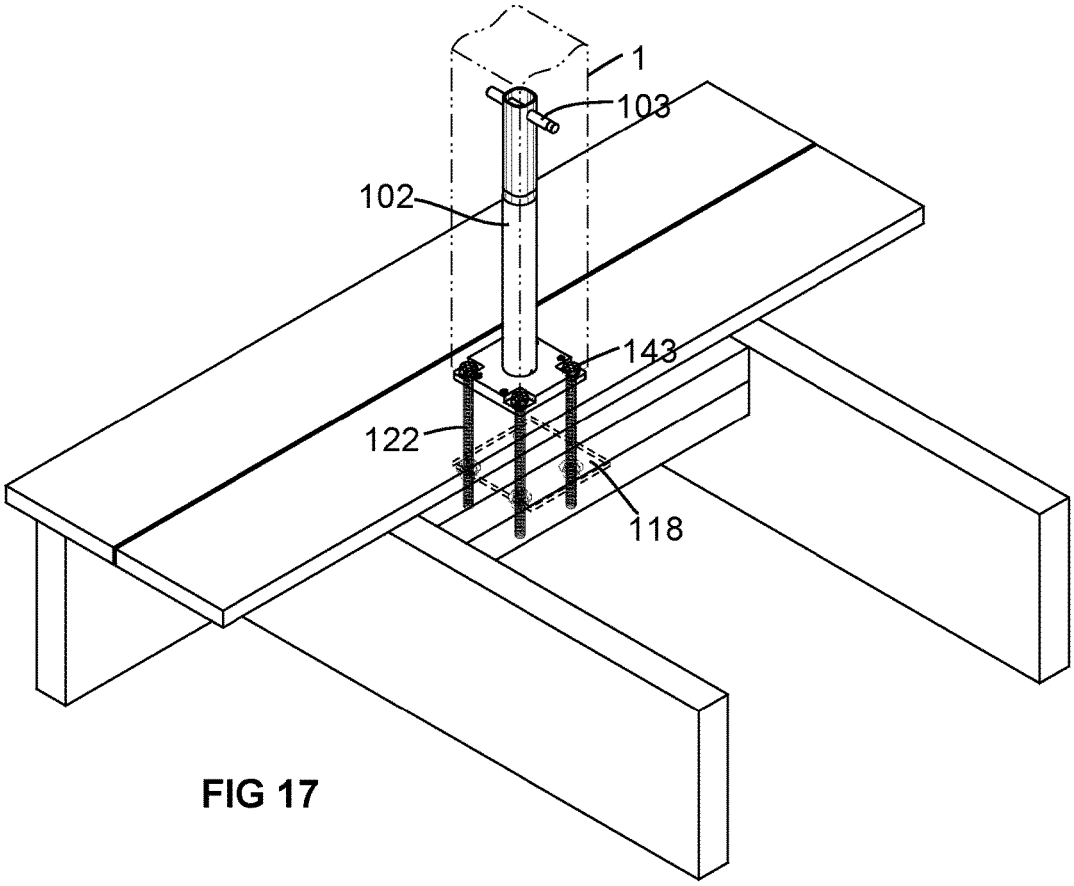
FIG. 17 is a side view of a wood post, tube, transverse locking pin, base, fasteners and wood installation plate on a deck.
Figure 18:
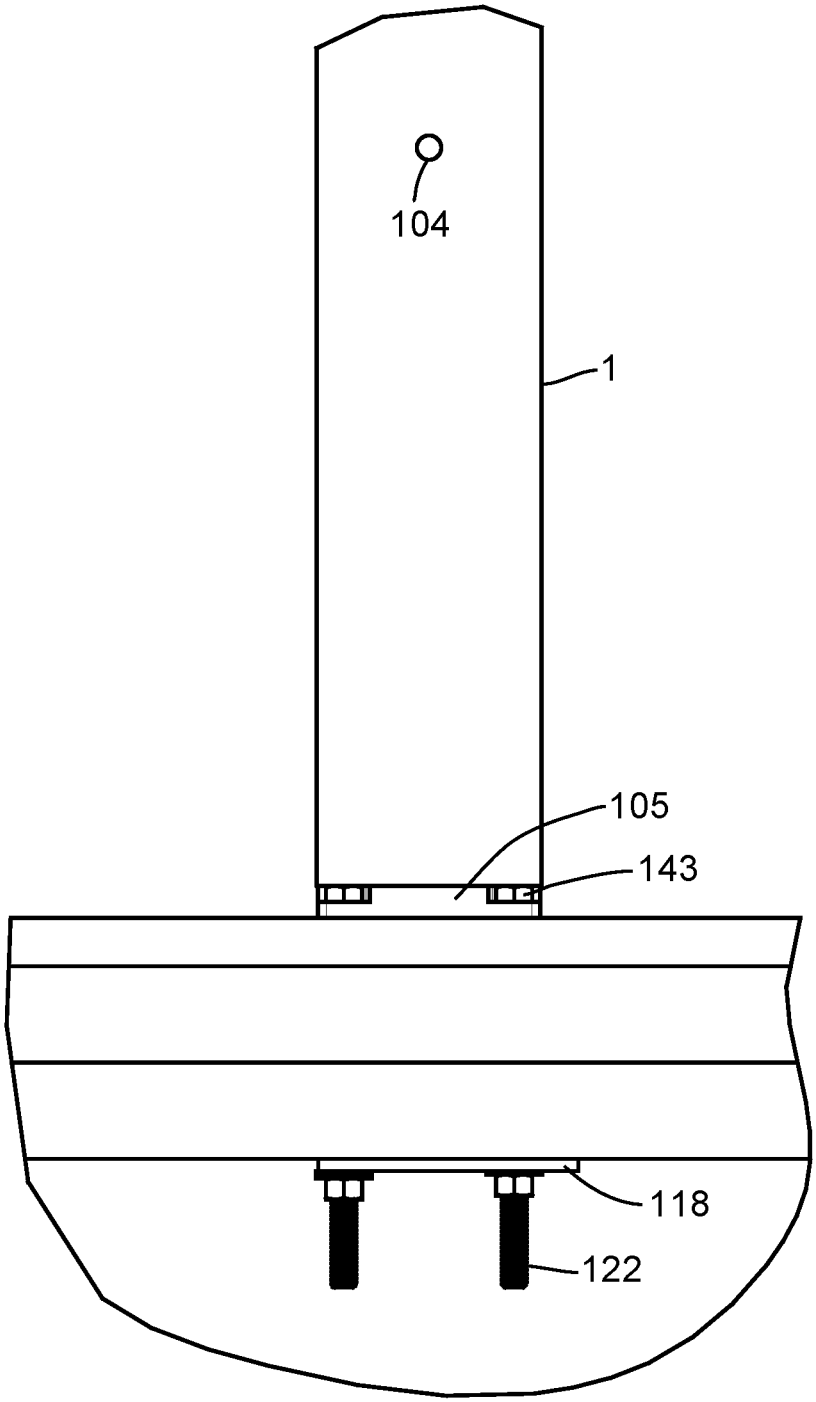
FIG. 18 is a perspective view of the wood post, hollow tube, transverse locking pin, base, fasteners and wood installation plate on a deck shown in FIG. 17.
Figure 19:
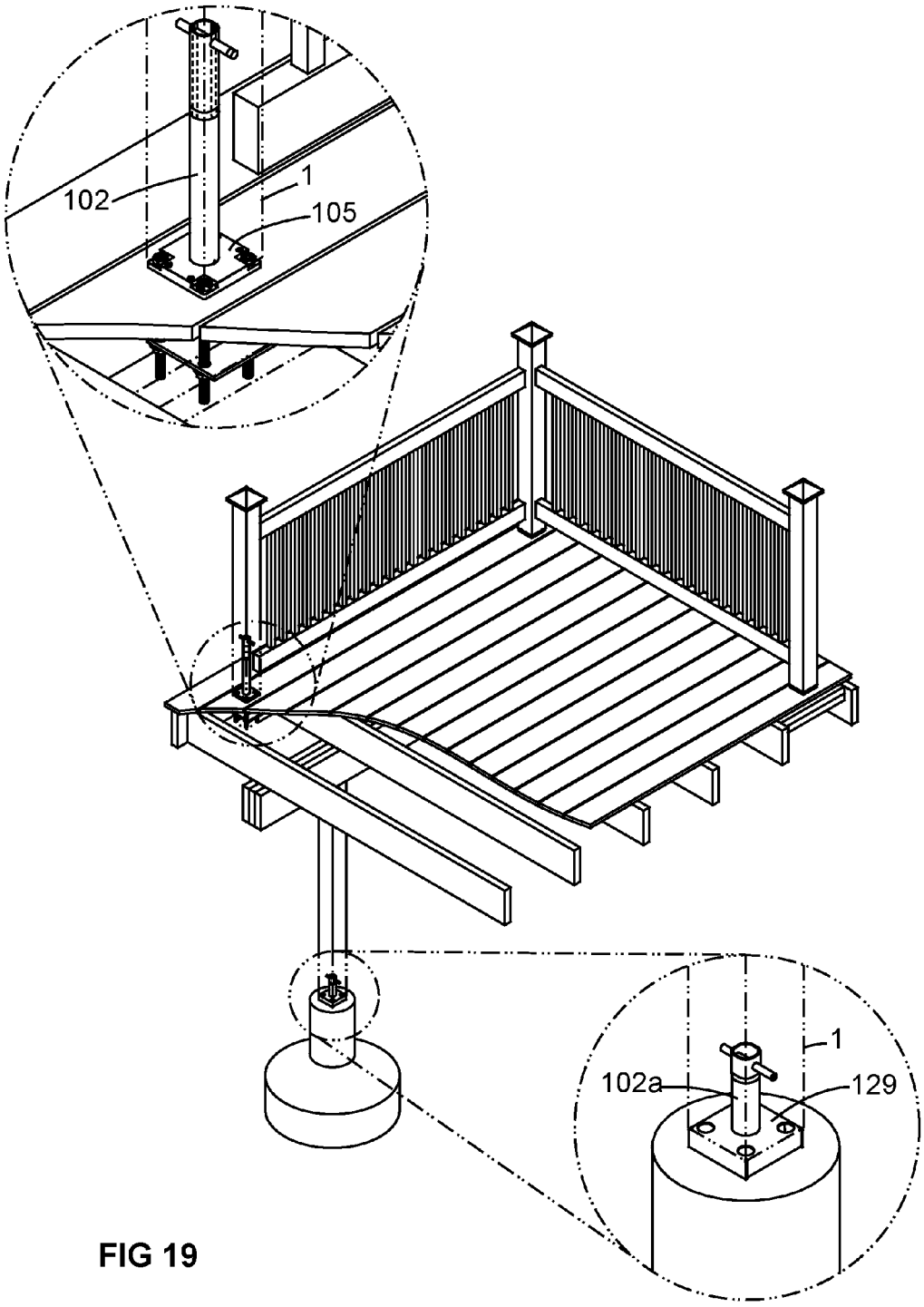
FIG. 19 is a perspective view of post fastening devices used in a deck and railing construction, one embodiment of the device being directed to lateral load resistance in the railing posts, and the other device being directed to compression load resistance in the deck support posts.
Figure 20:
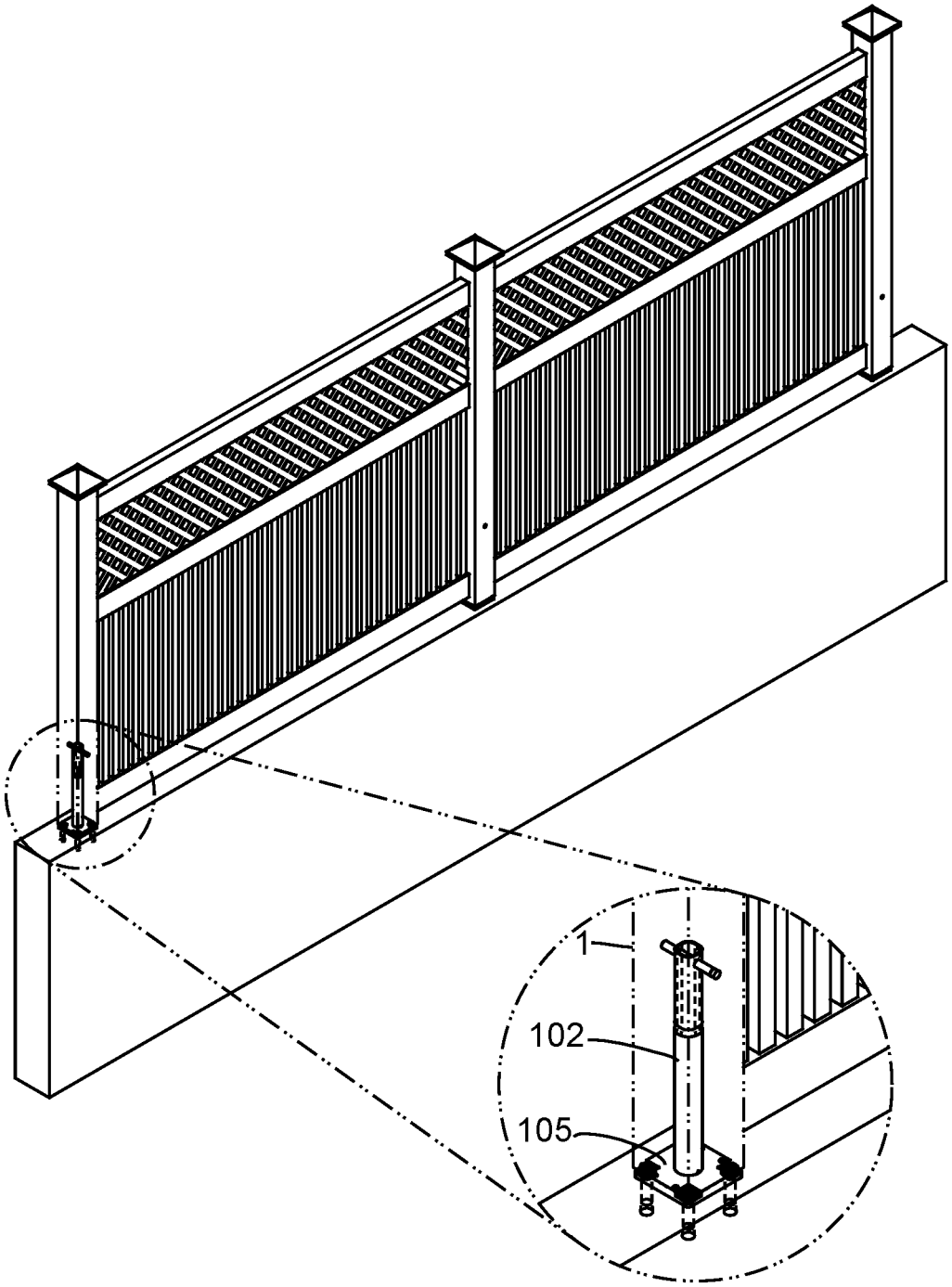
FIG. 20 is a perspective view of post fastening device used in a fence construction being directed to lateral load resistance in the fence posts.
Figure 21:
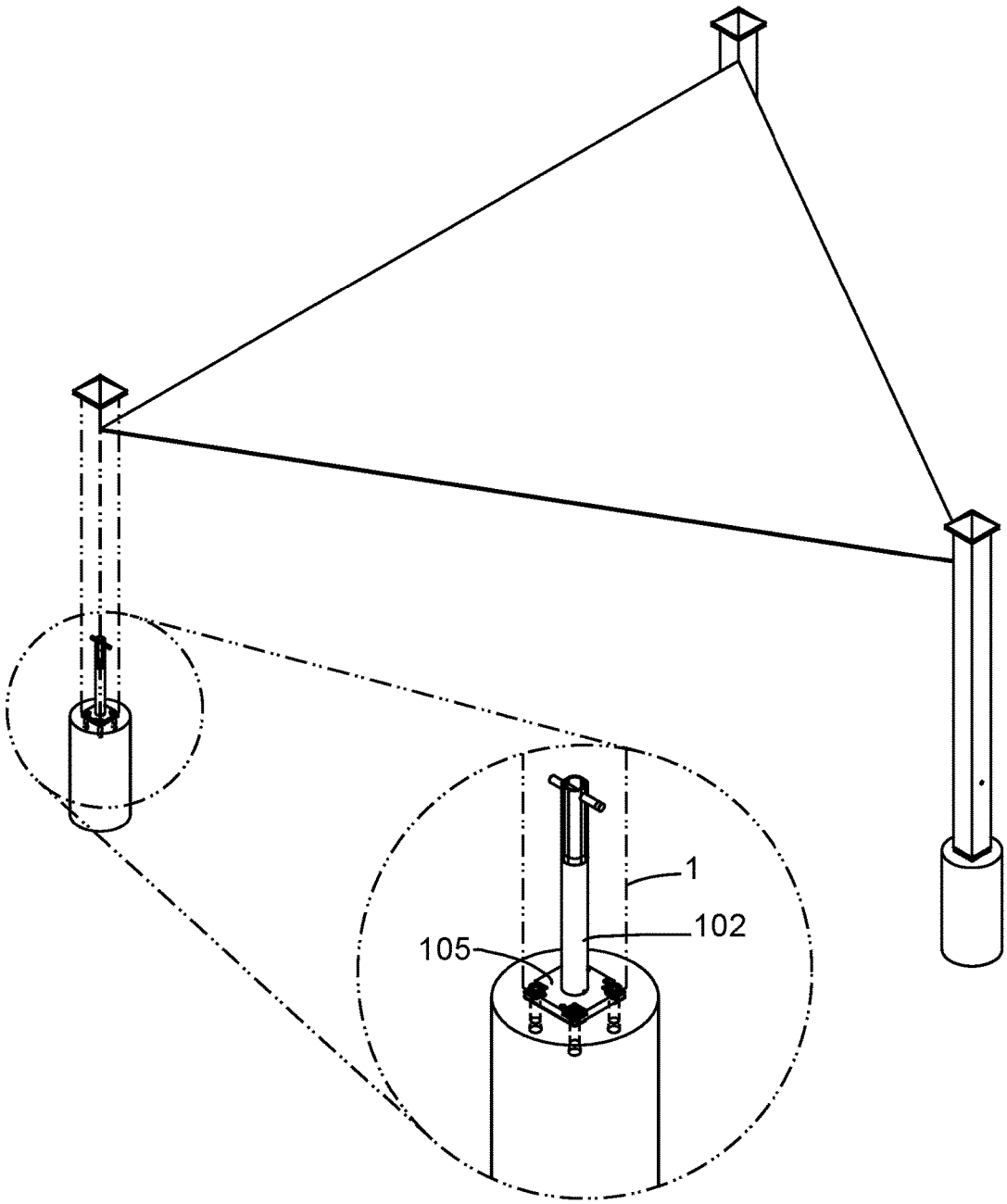
FIG. 21 is a perspective view of post fastening device used in a shade sail construction being directed to lateral load resistance in the sail support posts.
Figure 22:
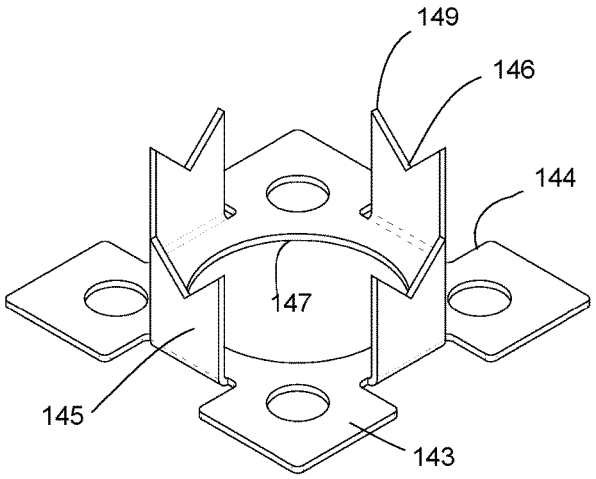
FIG. 22 is a perspective view of a tension bracket accessory.
Figure 23:
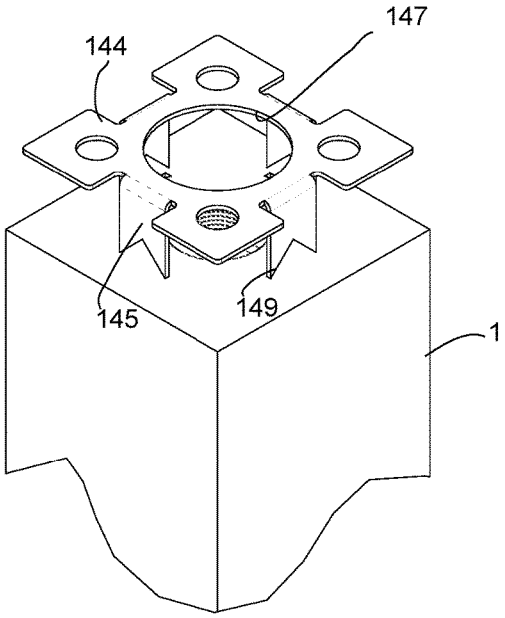
FIG. 23 is a perspective view of the tension bracket of FIG. 22 prior to being impaled into the end of the post.

FIG. 7 depicts a longitudinal sectional view of the tube 102 used for lateral load resistance devices and the varying wall thickness of the tube over the length of the tube. Characteristic of this tube is a thicker wall material in the lower portion 117 with a threaded portion 138 along the inside wall surface. The upper 116 and lower 117 segments of the tube are separated by the transitional zone 120. The wall thickness in the upper portion 116 is notably thinner than the lower portion 117. This thinner wall thickness makes it easier to form the flat surfaces 111. The flat surfaces 111 help a drill bit to locate and initiate cutting through the tube 102 as the bore 121 for the transverse bore pin 103 is drilled first through one side of the post, through the tube 102, and the other side post during installation. The thinner material of the upper portion 116 makes it easier for a drill bit to cut through yet still provide sufficient tensile strength while the post is under lateral load. In preferred embodiments, the wall of upper portion has a thickness of from about 1/16" to about 1/8". The thicker wall portion 117 of the tube ensures sufficient material for the threads 38 and maximum moment force resistance while the post is under lateral load. In preferred embodiments, the wall thickness of the lower portion is at least 1/4".

Referring to FIGS. 11-15, another embodiment of a post fastening device 101 of the present invention is shown that is mainly directed to handling compression forces as opposed to lateral forces. The base 129 of a compression device 101 and tube 102*a* may vary from those parts used for a device intended for lateral load resistance such as device 100 in several ways. The base 129 may be fabricated from sheet metal or steel to reduce material cost. One pair of side walls 133 are shorter whereas the adjacent pair of side walls are longer and folded so as to form a flat surface 142 and then transitioning into upward sloping panels 134 that are welded to the underside of the top planar surface of the base 129 in order to fortify the compression resistance of the base. Four large circular holes 135 are formed in the top planar surface of the base, and directly below each of them defined in the flat panel 142 are smaller holes 136 through which screws 122 pass. The larger hole 135 allows the larger diameter head 143 of the screw 122 to fit through the top planar surface in order to enter the smaller holes 136 and ultimately fasten the base 129 securely to the surface. The upper end of the tube 102*a* is formed in a similar way as previously described the respective tube 102. However, a hexagonal nut 131 or circular plug with a threaded aperture 137 is fitted into the lower terminus of the tube and welded in place, said nut 131 is set slightly deeper into the tube 102*a* so that a weld can be made between the nut 131 and the bottom edge of the tube. The threaded aperture 137 functions similarly to the threaded inner walls 138 of the tube 102 described previously herein for use for lateral loads. The threaded aperture 137 mates with the threaded rod 130 which is connected to the base 129. The rod 130 is fitted with a nut 132 and passes upwardly through an aperture 139 defined in the center of the top planar surface of the base 129. The nut 132 is welded to the underside of the top planar surface of the base 129 and the rod 130 is welded to the nut 132 to prevent it from rotating.

Referring to FIGS. 15-18, perspective and plan views of the tube 102, base 105, pin 103, fastening bolts 122 and plate 118 are depicted. The bolts 122 and plate 118 are used when the post fastening assembly is attached to a common wood joist framed structure. The thickness 119 of the plate 118 ensures that the nuts securing the bolts 122, which pass through holes 140, do not pull up into the wood blocking pieces that the bolts 122 pass through underneath the top surface deck material.

The following describes both the characteristics of the post anchoring devices and the method of employing them.

The first step is to install the hollow tube 102 into the post 1. This requires that the center of the bottom of the post be located by tracing diagonal pencil lines from corner to corner. A drill or boring auger of the same diameter as the tube 102 is used to bore a hole 141 from the center location into the post following the longitudinal center line of the post to a depth of about 1" further than the length of the tube 102. Depending on the length of the tube used, the bore can extend as little as three or four inches to as much as twelve to thirteen inches. The length of the tube may be varied depending on the intended use, from compression to moment load resistance. Shorter tube lengths may be better suited to compression load resistance whereas longer tube lengths may be better suited to moment load resistance.

As described herein, the tube has a thicker wall at the lower portion 117 and threads 138 tapped into the inner wall surface, and the tube has a thinner wall at the upper portion 116 as well as flat outer surfaces 111 formed along the upper length of the tube such that a partial square shape is formed into the tube but leaving radius corners 110. The tube 102 is oriented to the bore in the post with the thinner walled end of the tube entering the bore 141 first. The flat surfaces 111 of the upper portion 117 of the tube should be aligned with the flat surfaces of the post walls. There are also reference marks such as notches 109 on bottom edge 128 of the tube which are positioned along the circumference of the tube so as to represent where the flat surfaces 11 of the tube are located inside the post once the tube is fully inserted.

Once correctly oriented with the post, the tube 102 is inserted halfway into the bore 141 so that it can be determined with greater certainty what the exact line or path of the bore inside the post. This is a precautionary step because the hole can be bored slightly off the longitudinal center line of the post and therefore the path of the bore must be determined with sufficient certainty so that the user can determine where to drill through the post 1 in order to pass through the tube 102 to create the bore 121 in which to insert the transverse locking pin 103 or pins if more than one is use. This process is further described in the step that follows.

Fortunately, even if the hole for the tube has been bored slightly off line, the line can be determined with a high degree of certainty. This is done by inserting the tube 102 halfway into the post 1 and taking a straight edge or ruler and observing the center line of the tube and then envisioning the line extending along the post. When the straight edge has been placed in the correct location on the face of the post such that the user is confident the edge is parallel to the center line of the bore inside the post, a pencil line is drawn along the length of the post to mark it. The post is then flipped 190 degrees onto its adjacent side and the process is repeated. The imaginary center line of the bore inside the post is now traced thus leaving two lines on adjacent sides of the post 1.

Now the tube 102 can be inserted into the bore 141. To protect the threads of the tube 138, a bolt can be turned into the threads 138 and the user can strike the bolt to drive the tube 102 into the post 1 rather than exerting force near the threads 138. The tube 102 is carefully inserted so that the edge of the lower end or the tube is just below the flat planar surface 2 of the bottom of the post thereby leaving a small reveal. For example, for common softwoods the tube can sit about 1/16" to 1/8" below the surface of the post bottom 2 to preserve aesthetics. For hardwoods the tube can be set flush to no more than about 1/16" below the surface 2 to preserve aesthetics.

The next step is to prepare to drill the transverse hole 121 for the locking pin 103. If the post fastening assembly is designed for moment load resistance, it is common for two pins 103 to be inserted and thus the need to trace two lines on the post on adjacent faces of the post. Whereas, compression resistant designed assemblies typically only require a single pin 103. The location of the first pin 103 should be set by first measuring from the base 2 of the post 1 along the face of the post 1 the actual length of the tube 102 used and then marking the location one inch backward from the end of the tube. If a second locking pin 103 is needed, the same measurement is made along the second traced center line but the pin location is marked two inches backward from the end of the tube. Prior to drilling, a final check should be made to ensure that the flat faces 111 of the upper length 116 of the tube 102 are in fact parallel to the face of the post. This is easily done by observing the location of the notches 109 in the bottom edge 128 of the tube 102. In the event that the tube was mistakenly turned several degrees and now rests in the post so that the flat surfaces 111 which are to be drilled through for the pin 103 to pass are no longer parallel to the face of the post, the user can angle the drill to match the angle of variance of the flat surfaces 111 relative to the face of the post 1.

The transverse bore 121 is drilled the same diameter as the locking pin 103 and to a length that is just short of the opposite face of the post from whence the drilling began. This creates a "blind" bore for the pin 103 to insert into, said pin being shorter than the width of the post 1 such that a small gap between the end of the pin 103 and the opening of the bore 121 on the face of the post 1 allows for a tapered plug 104 to be fitted and sanded flush with the surface of the post 1 completely hiding the pin 103 from view. Plugs can be made of various wood species to match the post as desired. The post is now ready and attention can be turned to attaching the base 105 or 129 to a concrete surface or a wood framed structure.

The base 105 is set at the desired location on an approximately horizontal concrete or masonry surface and the corner through holes 107 can be used as a jig through which the user can drill holes into the concrete or masonry of the requisite diameter to match those of the concrete screws 122 or expansion bolts. Screws 122 are the preferred fastener as the heads 143 are lower profile and sit below the upper planar surface 123 and allow the flat bottom surface 2 of the post to turn above and not conflict with the screw heads 143. Prior to fastening the screws 122, the base 105 can be checked for level by using a small level and adjustments can be made by using common shims or by using the set screws 115 and the surface leveling plate 114. Once the base 105 is level, screws can be fastened and the plate secured to the surface. With tube 102 firmly secured inside the post 1, it can now be placed over the base such that the threaded rod 6 of the base 105 mates with the threads inside the tube 138. The post is turned at first by hand until the base surface 2 of the post 1 contacts the upper planar surface 123 of the base 105. In order to fully tighten the post on the base, it is recommended to use a makeshift wrench of dimensional lumber such as a 2"×10" or larger with a square cut out from one end that can accept the shape of the post and thereby greater leverage can be generated in order to fully tighten the post.

The objective is to tighten the post to the point that the tube is pulled down inside the bored cavity 141 so far as the locking pins 103 will permit and ideally such that the edge of the tube 128 which was intentionally set slightly below the bottom surface 27 of the post 1 is now as close to contacting the surface of the base 123 as possible. As those skilled in the art will appreciate, it would not be desirable for the edge of the tube 128 to fully contact the surface of the base 123 while the side walls of the post are not aligned with the side walls 126 of the base. For example, if the post was tightened to its apparent maximum extent because the tube bottom 128 had contacted the plate surface 123 but the post was still one eighth of a rotation from being square with the walls 126 of the base 105, it would be necessary to reverse the post slightly. This reversal might in some cases reduce the tension of the post 1 to the base 105 such that optimum performance is not achieved. Therefore, proper practice is to set the tube edge 128 into the bore 121 so that it is sufficiently below the surface of the bottom of the post so that once the base 105 and post bottom 2 contact each other the post can be further tightened several increments of quarter turns until it cannot be tightened further.

The method for installing the compression post fastening device to a wood or composite surface over a wood framed structure will now be described. The main differences between the compression device and the lateral load resistance device as described previously is that the compression device uses a lighter weight base 129 of formed sheet steel and a lighter weight and shorter tube 102*a*. The base 129 is placed in a desirable location on a wood or concrete surface. In the case of a concrete surface the holes 136 defined in the flat bottom flange 142 of the base 129 can be used as a template for a drill bit to pass through to drill the screw holes. Screws 122 designed for either wood or concrete are fitted through the larger holes 135 defined on the upper planar surface 123 of the base 129 and driven down to secure the plate to the surface.

The tube 102*a* having been inserted and secured into the post 1 by one or more locking pins 103 and hidden by plugs 104 is now located above the base 129 so that the threaded rod 130 is aligned with the threaded aperture 137 defined within the cylindrical disk or nut 131 welded to the inside walls of the tube 102*a*. The tube 102*a* and post 1 are turned tightly onto the upper remote terminus of the rod 130 pulling the base of the post 2 into tight contact with the upper surface 123 of the base 129. The rod 130 is firmly secured to the base 129 by virtue of it passing through aperture 139 in the top surface and the nut 132, said nut 132 being welded to the lower extremity of the rod 130 and the underside of the top planar surface 123 so that the lower remote terminus of the rod 132 meets the mounting surface providing an additional point for support, compression resistance and load dissipation. The resulting connection between the post 1 and the tube 102*a* and base 129 is similar in performance to a more obvious and visible external "U" shaped base using through bolts except this device has no external brackets or visible fasteners. This device is optimally designed for resisting compression and tension (uplift) forces yet provides an aesthetically improved appearance. Having described how both the lateral load and compression only resistant post fastening assemblies are installed to flat surfaces, a method for securing a lateral load resistant device to a wood framed structure will now be described.

The base 105 is located in the desired location on the surface. In order to provide the stability required, it is common practice to install an approximately 3½" piece of dimensional lumber and block it between the joists below each post location. This is usually accomplished by screwing together two pieces of 2× material such as 2×6 or 2×8. The blocking material is fitted precisely between the joists and pushed upwards until it contacts the underside of the decking boards. The blocking material is then screwed into place through each joist securing in place.

Long carriage bolts 122 are fitted through drilled holes in the decking and the blocking and passing through slightly oversized through holes 140 in an installation plate 118 of sufficient thickness 119 to effectively resist deformation when the post 1 is under maximum load. The carriage bolts are secured to the installation plate 118 by washers and nuts. The washers and nuts are now prevented from being pulled up into the wood material and a more rigid connection with reduced post deflection is achieved.

This is how the post fastening devices work and are secured to the various surfaces, whether it is for a lateral load resistant application or a compression and tension only application. The difference noted in the lateral load device is an overall tapering or reduction of wall thickness along its length from thickest at the lower remote terminus to thinner at the upper remote terminus combined with four flat planer surfaces. The change in wall thickness can be a continuous taper achieved by machining or discrete changes in wall thickness at certain points along the tube length. The thinner material and flat surfaces in the upper length make it easier for a user to initiate drilling on a flat rather than a round surface and to cut through it rather than a thicker round material.

The moment generated will create a tension force on the side of the post where the load is applied and a compression force on the opposite side. The ability of the locking pin embedded within the wood fiber to resist this tension force is dependent upon the bending strength of the pin and the density of the wood. When the pin does not bend and the wood surrounding it is not compressed, the tube 102 remains stationary within the post 1 directing the load to the rod 30 and the carriage bolts 122 and the installation plate 18.

An important aspect to the efficacy of the post fastening assembly for lateral load force resistance is the ratio of the length of the tube 102 to the length of the post 1. When observing any given length of post, the moment generated at the connection between the base 105 and the base of the tube 102 is a function of the ratio of the length of the tube to the post and can be expressed using the mathematical principles of a second class lever. For example, a 12 inch tube installed in a 36 inch post will result in a moment at the tube plate connection that is double the lateral force applied at the top of the post. The formula used to calculate the multiplier is expressed within the parentheses ((36−12)/12=2). In this example a 500 lbs lateral load generates 1000 ft-lbs of torque. The shorter the tube, the greater the torque generated. A 6 inch tube generates 2500 ft-lbs of torque ((36−6)/6=5). Understanding this relationship helps illustrate that the less dense the wood fiber is, the lower the torque forces the post fastening assembly will resist before the remote end of the post begins to rotate over the remote end of the tube 102 within the post 1. Rotation is prevented only so long as the pin and the tube remain immobile within the post 1. This can be addressed by either increasing the density of the wood or increasing the length of the tube.

This also means that the post fastening assembly can be further varied for different purposes so that it can be useful in fence post applications, pergolas, light standards or even shade sail support posts which must resist high tension forces at the remote ends of the posts. Each broad range of application will determine the specifications of the dimensions and form of each component part for the most efficient and economical performance.

Referring to FIGS. 22 to 25, there is shown a support plate such as tension bracket 144 that may be used with a post fastening device of the present invention, such as post fastening devices 100 or 101. The tension bracket 144 comprises a planar member 143 and vertical blades or tabs 145 that extend perpendicularly upward from the planar member around a central aperture 147. The upper edge of the tabs 145 have a V cut 146 to define prongs 149 that facilitate impalement of the tabs 145 into wood post 1.

The tension bracket 144 is an optional accessory that may be used with the post fastening device to raise the performance of softer wood posts such as western cedar and redwood to match that of harder softwoods like pine, spruce and hemlock. It accomplishes this by providing tensile resistance to counteract the opposing vertical compression and tension forces that are concentrated at the bottom of the post when the upper remote end of the post is under lateral load. These antagonistic forces transfer over to opposing horizontal forces and are expressed along the bottom surface of the post 1 and ultimately threaten to pull the post apart from the center of the post.

Figure 24:
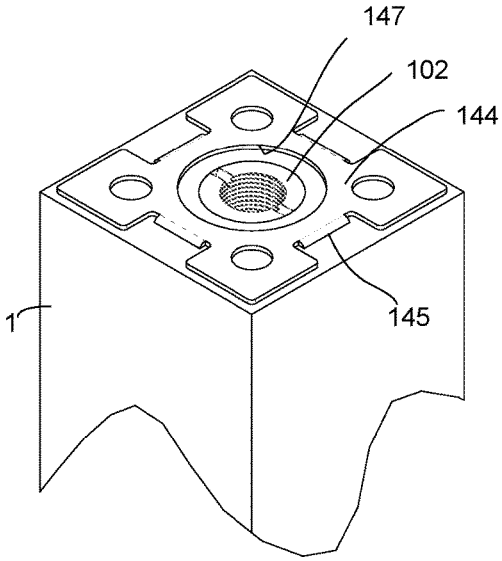
FIG. 24 is a perspective view of the tension bracket of FIG. 22 after having been impaled fully into the end of the post.
Figure 25:
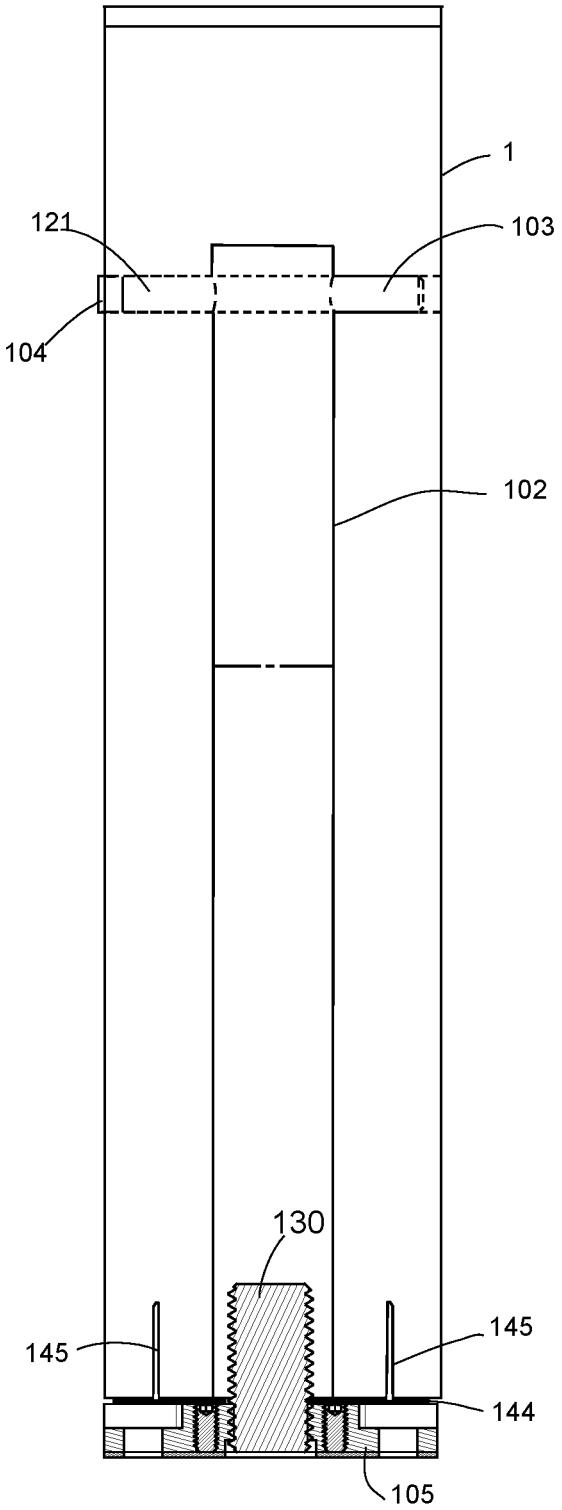
FIG. 25 is a side cross section view of the tension bracket of FIG. 22 used the post fastening device of FIG. 1.

The bracket 144 is aligned and located in such a way that the circumferential edge of the central aperture 147 is equidistant from the outside diameter of the circumferential edge of the tube 102 (or 102*a*) of the post fastening device 100 (or 101), as shown in FIG. 24, after the bracket 144 having been impaled into the end of the post. The aperture 147 is an important feature for the bracket to be used with the post fastening devices 100 or 101 given that the tube 102 or 102*a* is inset approximately 1/16" (lower) from the flat planar surface of the end of the post 2. This distance is determined by the pitch of the threads and is ideally set to account for at least 180° of additional rotation once the post bottom 2 contacts the upper planar surface 123 of the base. This allows for the tube to be pulled downward within this small gap and increase the tension force between the base 105 and the bottom 2 of the post 1. However, when the bracket 144 is used it is not necessary to set the tube 102 or 102*a* the full 1/16" lower than the end of the post given that the bracket itself is 1/16" thick. With applications that use the bracket, the tube may be set very nearly flush or about 1/32" below the bottom surface of the post.

For optimal functioning, using the minimal amount of material, and to prevent the post walls from being prone to splitting, the distance from the peripheral post wall surface to the outside surface of the vertical tabs 145 is about 1/2" for a 4"×4" wood post. Preferably, the inside surface of the tabs 145 are no less than about 5/8" from the outside wall of the tube 102. The V shaped zone 146 on the tab 145 facilitates the impalement of the sharp prongs 149 into the post. The tabs are impaled by striking each tab successively in a circular pattern so each tab descends into the post relatively equally to the other. Once firmly embedded into the post, the opposing forces acting to pull the post apart are counteracted by the tensile strength of the flat planar base of the bracket 144, which is also advantageously completely underneath the post and hidden from view.

Other aspects and features of the present invention will become apparent to those of ordinary skill in the art upon review of the following description of specific embodiments of the invention in conjunction with the accompanying figures.

While the above description and illustrations constitute preferred or alternate embodiments of the present invention, it will be appreciated that numerous variations may be made, such as altering the perimeter shape, without departing from the scope of the invention. It is intended that the invention be construed as including all such modifications and alterations.

The invention claimed is:

1. A method of mounting a post having a bottom end to a construction surface, the method comprising:

mounting onto the construction surface a base having a planar top surface and a threaded rod extending from the top surface;

machining a longitudinal bore into the bottom end of the post along a central longitudinal axis of the post;

inserting into the longitudinal bore a tubular member having an upper end and a lower end with internal threads complementary to the threads of the rod, the tubular member defining a lower portion and an upper portion having a thinner wall thickness than that of the lower portion, the lower portion being sized to be received within the longitudinal bore with a friction fit therebetween, and the upper portion defining diametrically opposed planar longitudinal external surfaces;

machining a transverse bore passing through a portion of the post and the planar longitudinal external surfaces of the upper portion;

inserting a dowel rod into the transverse bore in a manner that the dowel rod passes through the upper portion of the tubular member; and threading the lower end of the tubular member onto the rod of the base and tightening thereof until the post is secured to the base and thereby to the construction surface.

2. The method of claim 1 wherein the threaded rod on the base is located at the center of the top portion.

3. The method of claim 2 wherein the threaded rod is perpendicular to the top surface.

4. The method of claim 3 wherein the base further includes a planar bottom surface opposite the top surface and a plurality of mounting holes extending from the top surface to the bottom surface, and the step of mounting onto the construction surface comprises securing the base to the construction surface with screws or bolts through the mounting holes.

5. The method of claim 4 wherein the mounting holes are countersunk with respect to the top surface so that heads of the screws or bolts are flush or below the top surface.

6. The method of claim 1 further comprising the step of mounting a support plate onto the bottom end of the post prior to the step of threading the lower end of the tubular member onto the rod, the support plate having a hole sized to accommodate the lower end of the tubular member, and the step of mounting the support plate includes aligning the hole with the longitudinal bore.

7. The method of claim 6 wherein the support plate includes one or more blades extending from one side of the support plate and the step of mounting the support plate comprises driving the blades into the bottom end of the post.

8. A post fastening device for mounting a post to a construction surface, the device comprising:

a base having a planar top surface and a threaded rod extending from the top surface;

a tubular member for insertion into a longitudinal axial bore on the bottom end of the post, the tubular member having an upper end and a lower end with internal threads complementary to the threads of the rod, the tubular member defining a lower portion and an upper portion having a thinner wall thickness than that of the lower portion;

diametrically opposed planar longitudinal external surfaces defined on the upper portion to facilitate drilling of a transverse bore through a portion of the post and the upper portion when the tubular member is within the longitudinal bore; and a dowel rod for insertion into the transverse bore, the dowel rod being sized to pass through the upper portion and a portion of the post on both sides of the upper portion.

9. The device of claim 8 wherein the threaded rod on the base is located at the center of the top portion.

10. The device of claim 9 wherein the threaded rod is perpendicular to the top surface.

11. The device of claim 10 wherein the base further includes a planar bottom surface opposite the top surface and a plurality of mounting holes extending from the top surface to the bottom surface for receiving screws or bolts for mounting the base to the construction surface.

12. The device of claim 11 wherein the mounting holes are countersunk with respect to the top surface so that heads of the screws or bolts are flush or below the top surface.

13. The device of claim 8 further comprising one or more threaded levelling holes passing through the base from the top surface to the bottom surface and being adjacent an edge of the base, and a set-screw within the one or more levelling holes being flush or below the upper surface and operable to act against the construction surface to raise or lower the base relative to the construction surface to effect tilting of the rod.

14. The device of claim 13 further comprising a levelling plate for placement between the base and the construction surface to provide a rigid surface upon which the set-screw of the one or more leveling holes may operate.

15. The device of claim 13 wherein the support plate includes one or more blades extending from one side of the support plate for being driven into the bottom end of the post.

16. The device of claim 15 wherein the one or more blades is positioned around the periphery of the hole and no less than about ⅝" away from the hole.

17. The device of claim 16 wherein the one or more blades includes a V cut on the leading edge to define pointed prongs to facilitate the impalement of the blade into the bottom end of the post.

18. The device of claim 8 further comprising a support plate having a hole sized to accommodate the lower end of the tubular member and adapted to being fastened onto the bottom end of the post with the hole aligned with the longitudinal bore.

19. The device of claim 8 wherein the wall thickness of the lower portion is at least ¼".

20. The device of claim 19 wherein the wall of upper portion has a thickness of from about 1/16" to about ⅛".

21. The device of claim 8 wherein an external surface portion of the tubular member adjacent the lower end includes a reference mark vertically aligned with one or more of the planar longitudinal external surfaces.

* * * * *